United States Patent [19]

Toro et al.

[11] Patent Number: 4,531,381

[45] Date of Patent: Jul. 30, 1985

[54] COOLER ASSEMBLY

[76] Inventors: Henry D. Toro, 85 E. 34 St., Hialeah, Fla. 33013; Erick Valle, 1502 E. 8 Ct., Hialeah, Fla. 33010

[21] Appl. No.: 647,760

[22] Filed: Sep. 6, 1984

[51] Int. Cl.[3] ..... F25D 3/08

[52] U.S. Cl. ..... 62/372; 62/457

[58] Field of Search ..... 62/457, 371, 372, 331, 62/377

[56] References Cited

U.S. PATENT DOCUMENTS

| | | | |
|---|---|---|---|
| 583,652 | 6/1897 | Mulligan | 62/372 |
| 592,781 | 11/1897 | Hertwig | 62/457 |
| 2,496,296 | 2/1950 | Lobl | 62/457 X |

FOREIGN PATENT DOCUMENTS

| | | | |
|---|---|---|---|
| 509753 | 3/1952 | Belgium | 62/457 |

*Primary Examiner*—Lloyd L. King

*Attorney, Agent, or Firm*—John Cyril Malloy

[57] ABSTRACT

The present invention relates to a cooling assembly of the type designed to maintain a bottle of wine or like beverage at a chilled temperature and in a predetermined orientation to facilitate serving thereof. A housing includes a cooling compartment removably secured therein in surrounded relation to insulating material wherein the cooling compartment may be at least partially filled with water and separately subjected to a freezing environment for freezing the water and forming ice to be used as a coolant. A closure and a cover structure is mounted on the cooling compartment to provide access to a coolant chamber while at the same time serving to separate the interior of the cooling compartment from ambient temperature surrounding the housing. Auxiliary compartments are provided on the housing for the storage of glasses, bottle opening structures and like ancillary objects.

16 Claims, 5 Drawing Figures

COOLER ASSEMBLY

BACKGROUND OF THE INVENTION

1. Field of the Invention

A housing formed from an insulating material and having a cooling compartment removably secured thereto in surrounded relation to the insulating material for maintenance of a reduced temperature wherein a coolant is added to the cooling compartment and subjected to a freezing environment, independent of the housing, for freezing of the coolant. The cooling compartment with frozen coolant is then returned to the housing for storage of a bottled wine or like beverage therein so as to make it readily available for serving.

2. Description of the Prior Art

The serving of bottled wine, champaign, etc. generally entails the placing of the bottle within a bucket at least partially filled with ice and water such that the exterior surface of the bottle is in direct contact with the ice water mixture. The contents of the bottle is thereby maintained at a reduced temperature relative to ambient temperature. Problems associated with this technique include water dripping directly from the bottle onto the dining or serving area and frequently onto people seated around such serving area. In order to overcome the mess normally associated with the above set forth technique, a napkin or towel is placed around the exterior of the bottle in order to absorb any drippings. While somewhat effective, this technique is generally considered to be cumbersome and less than totally desirable. In addition, since there is no regulation of the coolant involved but merely a filling of an ice bucket with an ice and water combination, there is no reasonable control of the temperature to which the bottled wine is subjected. This often results in the wine becoming too chilled.

In order to overcome the above set forth disadvantages, numerous designs and structures exist in the prior art specifically directed to the cooling of a bottled liquid, including wine, wherein the cooling structure or apparatus provides ready access to the bottle to facilitate serving of the beverage therefrom in a convenient manner while at the same time attempting to maintain the bottled beverage at a preferred reduced temperature. Prior art structures of the type referred to while not specifically limited to the cooling of a bottled beverage are represented in the U.S. Pat. Nos. to Ruggieri, 3,034,305; Taylor, 4,250,998; Gardner, 4,255,944; 4,388,813; 4,393,665; and Kelly, Jr., 4,344,303.

While the structures set forth in the above noted patents are generally representative of numerous prior art devices and are operable for the function intended, frequently such structures are also less than desirable by not providing adequate cooling facilities to properly maintain a preferred reduced temperature of the bottled wine or like beverage. Also, such structures frequently do not adequately enhance the atmosphere of a special moment or occasion by combining a pleasing aesthetic appearance of the cooling assembly while at the same time rendering the bottled beverage available for efficient serving. In addition, the type structure mentioned above also generally maintains the bottle and the beverage contained therein in a substantially upright position thereby ignoring the condition or treatment of the wine once the bottle has been opened. It is well recognized that certain wines are better appreciated when "breathing" is allowed to take place after the cork or closure has been removed from the bottle. To best accomplish such breathing, the bottle is oriented at a predetermined angle so as to increase the internal, exposed surface area of the wine.

Accordingly, there is a need in the industry for a cooling assembly structured to facilitate serving while at the same time capable of overcoming certain disadvantages recognized in the prior art and just as importantly structured to be aesthetically pleasing so as to blend in with the surrounding atmosphere and add to special occasions or moments when wine or a like beverage is served.

SUMMARY OF THE INVENTION

The present invention is directed towards a cooler assembly designed to maintain a bottled wine or like beverage at a preferred reduced temperature while at the same time presenting the bottled wine in an appropriate and attractive manner to facilitate serving thereof from a location adjoining a dining or serving area.

More specifically, the cooler assembly of the present invention comprises a housing having a cooling compartment removably mounted therein. The cooling compartment includes an outer sleeve disposed in surrounding, spaced apart and substantially telescoping relation about an inner sleeve. A coolant chamber is defined by the space between the spaced apart inner and outer sleeves wherein the coolant chamber is specifically dimensioned and structured to maintain a coolant therein. Such coolant can be in the form of ordinary tap water which is disposed to at least partially fill the coolant chamber. The entire cooling compartment is then placed within a freezing environment such as a freezer associated with a typical domestic refrigerator. The cooling compartment is allowed to be maintained in the freezer until the water is totally or partially frozen. The cooling compartment is then removed and placed back into the housing where, as set forth above, it is disposed in surrounded relation by insulating material.

A cover means is removably secured to the cooling compartment and is structured to close and seal the coolant chamber to prevent leakage therefrom. The closure assembly is obviously removable so as to provide access for filling of the coolant chamber in the manner set forth above. The closure means further includes a cover means which is preferably in the form of a flexible material diaphragm having a plurality of separable segments. Each of the segments are correspondingly dimensioned and configured and normally biased into a substantially covering relation to the hollow interior portion of the cooling compartment in which a bottle of wine or like beverage is disposed and maintained for cooling. Once so disposed, the bottle passes effectively through and beyond the separable diaphragm segments and the flexibility of such segments forces their engagement about the exterior surface of the bottle regardless of the configuration thereof. Accordingly, even when a bottle is maintained on the interior of the cooling compartment, the plurality of segments serve to effectively close and at least partially seal the hollow interior portion of the cooling compartment. The compartment is segregated from the ambient temperature surrounding the exterior of the housing. The bottle is thereby maintained in a cooled environment for a prolonged period of time.

Other structural features associated with the subject cooler assembly include the positioning of the cooling compartment and any bottle disposed therein, at a predetermined angular orientation relative to horizontal. A base of the housing is structured to support the housing on a horizontal supporting surface and the remainder of the housing is structured to accomplish such angular orientation. Such predetermined angular orientation of the bottle allows for a greater surface area of the wine or beverage within the bottle to be exposed to atmosphere. This greater surface area facilitates breathing. The angular orientation as well as the overall design of the housing also adds to the aesthetic appearance and thereby blends into a special atmosphere rather than detracting therefrom such as when conventional ice buckets or like containers are utilized to chill a bottle of wine.

Further strutural features of the cooler assembly includes the provision of auxiliary compartments which may take the form of a separate compartment for the removable storage of drinking glasses. Such glasses are readily accessible to one serving a bottle of wine. Other auxiliary compartments may be specifically structured to include a bottle opening device such as a corkscrew normally associated with the opening of bottles of wine. By virtue of these ancillary objects all being stored or maintained within the same housing used to contain the bottle of wine in a chilled state, the subject assembly can define a complete, essentially self-contained, unit. Such a unit not only effectively accomplishes the maintenance of a bottle of wine at a predetermined reduced temperature but adds to the overall affect and/or atmosphere of an occasion by packaging of the components of the assembly in an attractive, aesthetically pleasing manner.

The invention accordingly comprises the features of construction, combination of elements and arrangements of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
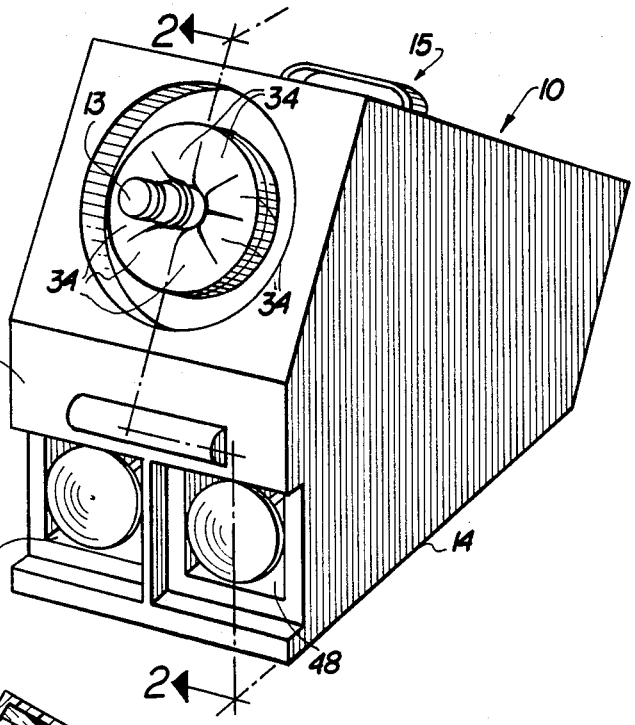
FIG. 1 is an isometric view of the cooling assembly of the present invention.

As shown in FIGS. 1 through 4, the present invention is directed towards a cooler assembly generally indicated as 10 and including a housing 12 primarily designed to be supported on a substantially horizontal surface by a base portion 14. In addition, for ease of carrying or transporting the assembly 10, a handle structure generally indicated as 15 is connected or may be part of an upper portion of the assembly as clearly shown in FIGS. 1, 2 and 3.

The housing 12 is primarily formed from an insulating material 16 such as polystyrene or like foam structured material. Obviously, other well recognized insulating material having sufficient rigidity or structural integrity can be utilized. The housing 12 includes an outer shell-type casing 18 serving to contain the insulating material 16 therein and generally defining the exposed or outer surface of the housing 12.

Figure 2:
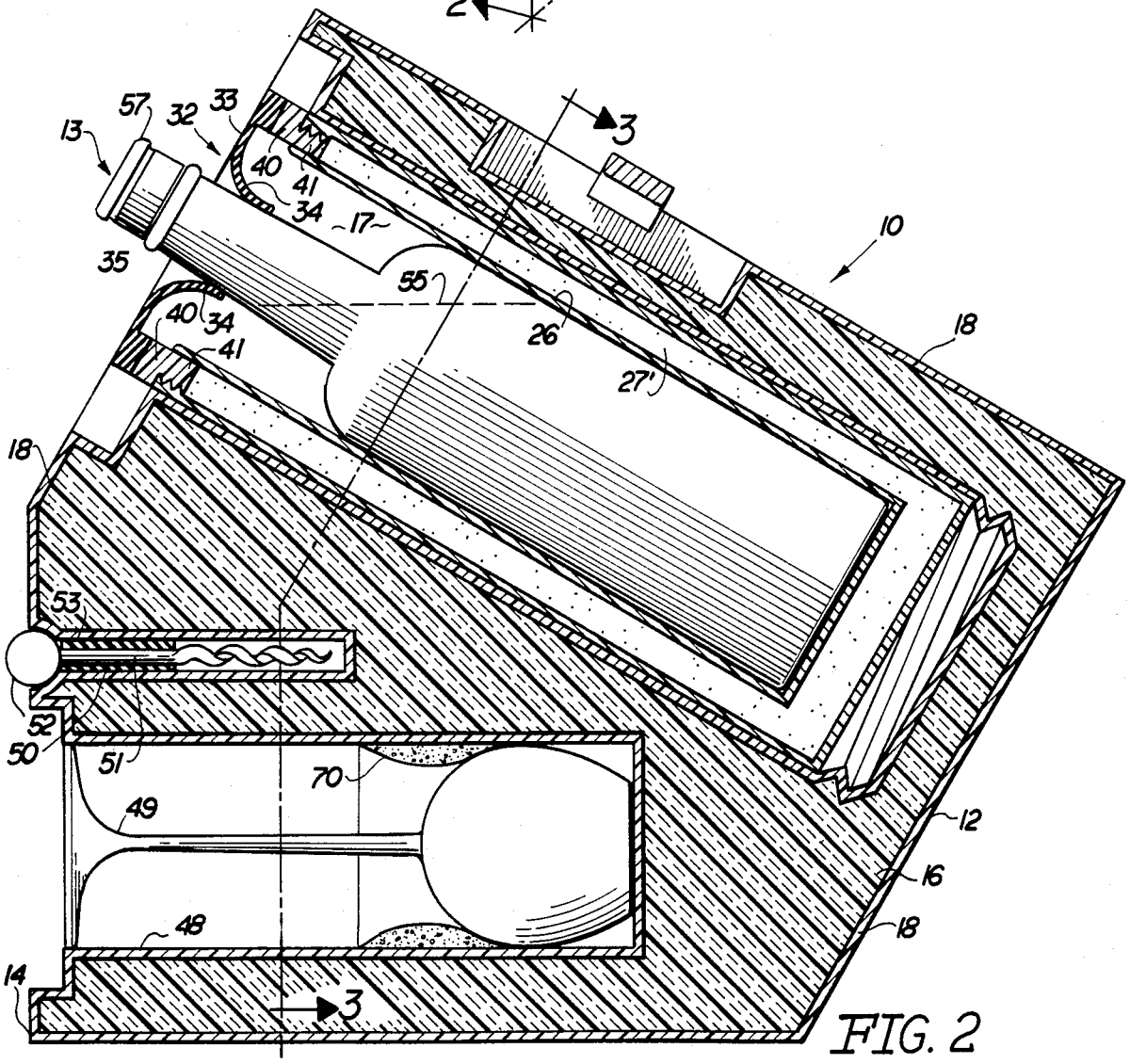
FIG. 2 is a sectional view along line 2—2 of FIG. 1.
Figure 3:
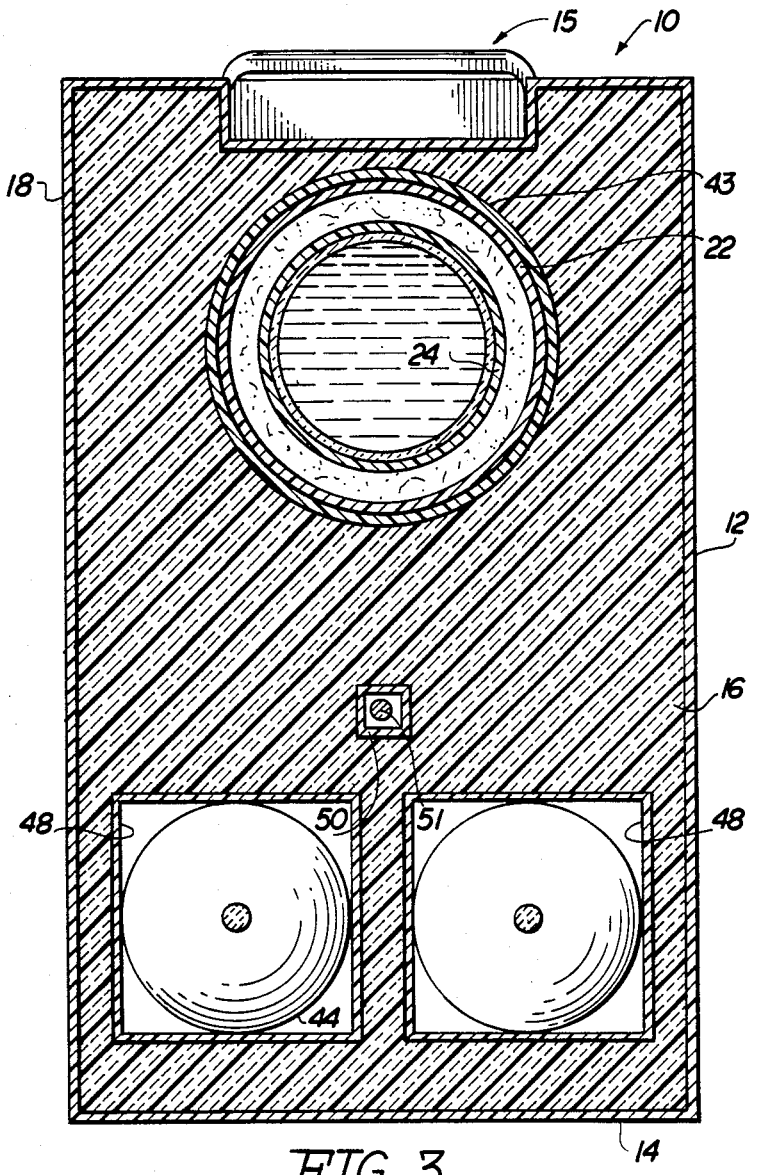
FIG. 3 is a sectional view along line 3—3 of FIG. 2.
Figure 4:
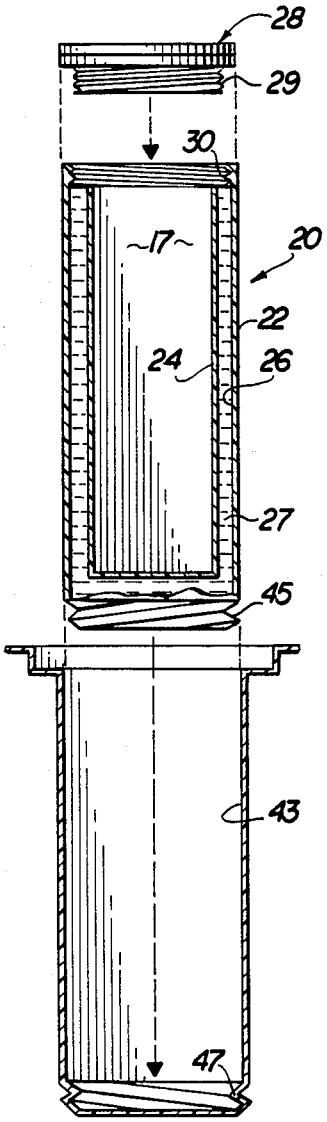
FIG. 4 is a detailed view of structural details and relative positions of a cooling compartment and supporting channel as part of the housing of the cooling assembly of the present invention in sectional form.
Figure 5:
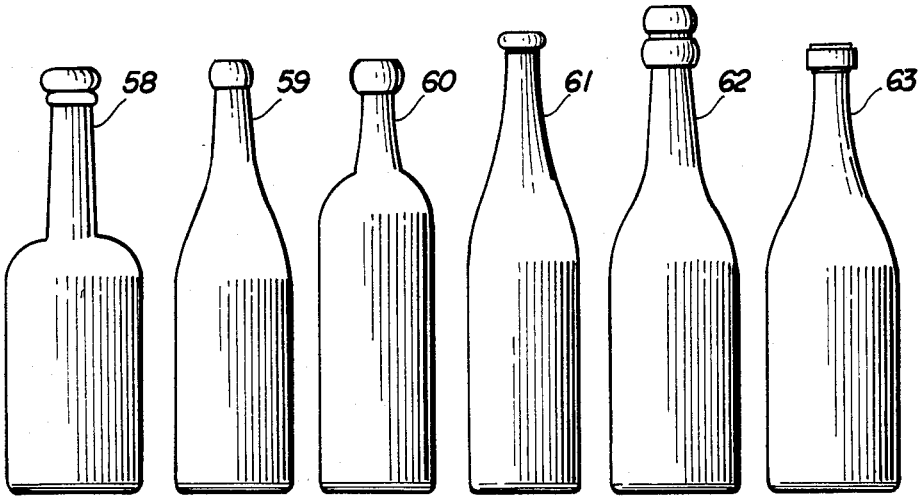
FIG. 5 is a representation of existing and/or possible bottle or container configurations capable of being positioned within the cooling compartment of the present invention.

With primary reference to FIGS. 2, 3 and 4, the cooler assembly 10 of the present invention comprises a cooling compartment generally indicated as 20 (FIG. 4) defined by an outer sleeve 22 and an inner sleeve 24 disposed in substantially coaxial, telescoping but spaced apart relation to one another. This spaced apart relation defines a coolant chamber 26 therebetween in which coolant may be supplied. A closure means generally indicated as 28 is removably connected to the open or free end of the cooling compartment 20 due to the provision of a connecting means in the form of exterior and interior threaded connector portions 29 and 30 respectively.

With reference to FIG. 2, the closure means further includes a cover means generally indicated as 32 comprising a diaphragm 33 defined by a plurality of separable diaphragm segments 34 each of which are substantially equally dimensioned and formed of a flexible, substantially resilient material. When a bottle or like container 13 is present within the interior hollow portion 17 of the inner sleeve 24, the individual segments 34 serve to at least partially engage and/or embrace the exterior surface of the bottle 13 and thereby somewhat segregate the hollow interior portion 17 from the ambient temperature located exteriorly of the housing 12. When the bottle or like container 13 is not present within the hollow interior portion 17, the individual segments 34 of the diaphragm 35 are normally biased into a substantially planar configuration so as to again segregate the hollow interior portion 17 from ambient temperature. As clearly shown in FIG. 2, the hollow interior portion 17 is configured and dimensioned to receive and at least partially surround a major portion of the bottle 13.

Again with reference to FIGS. 2 and 4, the closure means 28 is further structured to have an outwardly extending substantially circular flange 40 integrally or otherwise connected to the depending, exteriorly threaded portion 41 so as to cover the entrance to the coolant chamber 26. Removal of the cover means 28 to the open position as shown in FIG. 4 allows filling of the coolant chamber 26 which initially may be in liquid form such as water 27.

An important feature of the present invention is the removable positioning and interconnection of the cooling compartment 20 within chamber 43. This allows the placement or positioning of the cooling compartment 20 within a greatly reduced temperature environment such as a freezer compartment of a residential refrigerator or the like. This in effect serves to allow extreme cooling of the water 27 and converting it into a true coolant such as ice 27' (FIG. 2). Obviously, volume and/or space requirements will be provided to comply with the normal expansion of the ice when it passes from the liquid state to the solid state.

The interior chamber 43 is disposed in mating engagement with the exterior sleeve 22 of the cooling compartment 20 and surrounds the remainder of the cooling compartment 20 so as to support it in surrounded relation by the insulating material 16 from which the housing 12 is primarily formed. The coolant 27' is thereby maintained at a reduced temperature for an extended period. Further, the cooling compartment 20 has a connecting means in the form of an additional threaded portion 45 on the exterior of outer sleeve 22 and at the distal end thereof as shown in FIG. 4. This threaded portion 45 is structured and disposed for mating engagement with an internally threaded portion 47 disposed on the interior of the chamber 43. In that the chamber 43 is in effect part of casing 18 and fixedly secured within the housing, the threaded engagement between connecting portions 45 and 47 also serves to removably secure the cooling chamber 20 in surrounded relation to the insulating material 16 once the coolant 27' has been brought to its proper frozen state.

Other structural features of the present invention include the provision of auxiliary chambers 48 designed to support drinking glasses or the like 49 therein so that ready access may be made thereto when wine is intended to be served. In order to prevent inadvertent displacement or removal of individual glasses 49 from the interior of the auxiliary compartment 48, a stop element 70 is provided. The stop element 70 is adhered into the internal surface of the chamber 48 and is made from a very flexible foam-like material which allows passage of the glass therebeyond as clearly shown in FIG. 2 but prevents its inadvertent removal from the chamber 48 unless force is exerted on the stem portion thereof. An additional auxiliary chamber 50 is provided to hold an opening device such as a corkscrew structure having the screw stem 51 maintained on the interior of housing 12 and the handle 52 of the opening structure being exposed as shown in FIGS. 1 and 2. In order to prevent displacement or inadvertent removal of the corkscrew structure from the chamber 50, a rubber or like flexible material sleeve 53 is secured to the stem portion 51 and is dimensioned to frictionally engage the interior surface of the chamber 50 such that the corkscrew will not fall therefrom.

A preferred embodiment of the present invention further comprises the structure of the housing 12 being such as to orient chamber 43 in an angular orientation relative to the substantially horizontally disposed base 14. This in turn of course orients the cooling compartment 20 in the same angular orientation wherein an inserted bottle 13 is also angularly oriented relative to horizontal. Such angular orientation serves to increase the surface area of the wine or like beverage within the container than if the bottle were maintained in an upright position. Such increased surface area 55 facilitates breathing of the wine once the cork or like closure 57 has been removed from the bottle 13.

It should also be noted that the specific configuration of the inner and outer sleeves 22 and 24 relative to the dimension and configuration of chamber 43 is such as to accommodate a number of various sized and configured bottle or container shapes as indicated by the representation of bottles 58 through 63.

It is therefore to be understood that the following claims are intended to cover all of the generic and specific features of the invention herein described, and all statements of the scope of the invention which as a matter of language, might be said to fall therebetween.

Now that the invention has been described,

What is claimed is:

1. A cooler assembly primarily designed to cool and maintain a bottled liquid at a lower than ambient temperature, said assembly comprising:

(a) a housing formed from insulating material and including a cooling compartment mounted to extend into the interior thereof, (b) said housing including a base portion structured for support of said housing on a substantially horizontal surface, (c) auxiliary compartment means formed within said housing and structured for containment of ancillary objects therein, (d) said cooling compartment comprising an inner sleeve and an outer sleeve secured together in substantially coaxial, spaced apart and telescoping relation to one another and a hollow interior portion defined within said first sleeve and dimensioned and configured to at least partially receive a bottle therein, (e) a coolant chamber defined between said spaced apart inner sleeve and outer sleeve and structured for maintenance of a coolant therein, said coolant chamber disposed in heat transferring relation to said inner sleeve and said hollow interior portion thereof, and (f) closure means connected to said cooling compartment and structured for closing and opening of said coolant chamber and at least partial closure of said hollow interior portion, whereby coolant may be added thereto or removed therefrom.

2. An assembly as in claim 1 further comprising a cover means mounted on said housing and structured for substantial covering of said hollow interior portion and for engagement with a bottle within said cooling compartment.

3. An assembly as in claim 2 wherein said cover means comprises a flexible material diaphragm including a plurality of separately movable and positionable segments, said segments inherently biased into a covering and at least partially sealing relation to said hollow interior portion in the absence of a bottle therein, said segments further structured for separable engagement with a bottle within said hollow interior portion and at least partially sealing relation thereto, whereby said hollow interior portion is at least partially isolated from ambient temperature on the exterior of said housing.

4. An assembly as in claim 3 wherein said plurality of segments are substantially equally dimensioned and configured and are integrally secured to said diaphragm, said diaphragm secured to said closure means and said closure means being removably attached to said housing in sealing relation to said coolant chamber and said hollow interior portion, the latter due to structural configuration of the diaphragm.

5. An assembly as in claim 1 wherein said cooling compartment is removably mounted within said housing in substantially surrounded relation by said insulating material, said cooling compartment selectively positionable in a freezing environment independent of said housing for freezing of said coolant disposed within said coolant chamber.

6. An assembly as in claim 5 further comprising a channel mean formed to extend into said housing and being surrounded by said insulating material and structured for support of said cooling compartment therein.

7. An assembly as in claim 6 further comprising connecting means for removably securing said cooling compartment within said channel means, said connecting means secured between an interior exposed surface of said channel means and an exterior portion of said cooling compartment and further structured for fixed orientation of said cooling compartment on the interior of said housing.

8. An assembly as in claim 7 wherein said connecting means comprises a first threaded portion mounted on said interior exposed surface of said channel means and a second threaded portion mounted on said exterior portion of said cooling compartment in corresponding position relative to said first threaded portion, said first and said second threaded portions structured and cooperatively disposed for mating engagement with one another and securement of said cooling chamber within said channel means.

9. An assembly as in claim 8 wherein said first threaded portion is formed adjacent an interior closed end of said channel means and said second threaded portion is formed on the exterior of a distal closed end of said outer sleeve and positioned for mating engagement with said first threaded portion.

10. An assembly as in claim 1 wherein said cooling compartment is disposed within said housing at a predetermined angular orientation relative to said base portion, said angular orientation determined by orientation of liquid within a bottle disposed within said cooling compartment.

11. An assembly as in claim 10 wherein said cooling compartment is angularly oriented substantially 30 degrees relative to horizontal and said base portion and is structured for substantial coaxial support of a bottle therein, whereby liquid within the bottle is predisposed relative to the bottle interior.

12. An assembly as in claim 1 wherein said closure means is removably secured to said cooling compartment in substantially covering and sealing relation to said coolant chamber and any coolant therein, said closure means further comprising a cover means fixedly secured thereto and structured for substantial covering of said hollo interior portion, said cover means formed of a flexible material and being positionable into engaging relation with a bottle disposed within said cooling compartment and at least partially segregating disposition between said hollow interior portion and ambient temperature exteriorly of said housing.

13. An assembly as in claim 12 wherein said cover means comprises a flexible material diaphragm including a plurality of separably movable and positionable segments, said segments inherently biased into a covering and at least partially sealing relation to said hollow interior portion in the absence of a container therein, said segments further structured for selective engagement with a container within said hollow interior portion and at least partially sealing relation thereto and in at least partially isolating relation between said hollow interior portion and ambient temperature exteriorly of said housing.

14. An assembly as in claim 13 wherein said plurality of segments are substantially equally dimensioned and configured and are integrally secured to said diaphragm and said diaphragm being secured to said closure means, said closure means disposed and structured for removable attachment to said cooling compartment and in sealing relation to said coolant chamber and said hollow interior portion, the latter due to the structural configuration of said diaphragm.

15. An assembly as in claim 1 wherein said auxiliary compartment means comprises a first compartment structured to support drinking glasses on said housing in ready access to the user of a bottle within said hollow interior portion.

16. An assembly as in claim 15 wherein said auxiliary compartment means further comprises a second compartment structured to removably maintain a container opening structure therein.

* * * * *